US010775819B2

(12) United States Patent
Vannorsdel et al.

(10) Patent No.: US 10,775,819 B2
(45) Date of Patent: Sep. 15, 2020

(54) MULTI-LOOP VOLTAGE REGULATOR WITH LOAD TRACKING COMPENSATION

(71) Applicant: Avago Technologies International Sales Pte. Limited, Singapore (SG)

(72) Inventors: Kevin Roy Vannorsdel, Erie, CO (US); Yongjie Jiang, Santa Clara, CA (US); John Lynn McNitt, Fort Collins, CO (US); Jay Edward Ackerman, Fort Collins, CO (US)

(73) Assignee: Avago Technologies International Sales Pte. Limited, Singapore (SG)

( * ) Notice: Subject to any disclaimer, the term of this patent is extended or adjusted under 35 U.S.C. 154(b) by 2 days.

(21) Appl. No.: 16/249,755

(22) Filed: Jan. 16, 2019

(65) Prior Publication Data

US 2020/0225689 A1 Jul. 16, 2020

(51) Int. Cl.
*G05F 1/565* (2006.01)
*G05F 1/575* (2006.01)

(52) U.S. Cl.
CPC ..... *G05F 1/565* (2013.01); *G05F 1/575* (2013.01)

(58) Field of Classification Search
CPC ..... G05F 1/575
See application file for complete search history.

(56) References Cited

U.S. PATENT DOCUMENTS 5,631,598 A * 5/1997 Miranda ..... G05F 1/565 327/483
5,850,139 A * 12/1998 Edwards ..... G05F 1/565 323/280
6,246,221 B1 * 6/2001 Xi ..... G05F 1/575 323/280
6,300,749 B1 * 10/2001 Castelli ..... G05F 1/575 323/273
6,518,737 B1 * 2/2003 Stanescu ..... G05F 1/575 323/280
6,965,218 B2 * 11/2005 Scoones ..... G05F 1/56 323/274
6,977,490 B1 * 12/2005 Zhang ..... G05F 1/575 323/280
7,106,033 B1 * 9/2006 Liu ..... G05F 1/575 323/280

(Continued)

*Primary Examiner* — Yusef A Ahmed
(74) *Attorney, Agent, or Firm* — Morgan, Lewis & Bockius LLP

(57) ABSTRACT

A multi-loop voltage regulator with load tracking compensation includes a first closed-loop feedback network configured to receive a supply voltage from a power supply and drive an output voltage that is smaller than the supply voltage to a load. The multi-loop voltage regulator includes a second closed-loop feedback network connected to the first closed-loop feedback network and configured to regulate the output voltage between a first supply voltage rail and a second supply voltage rail for a given load current, in which the second closed-loop feedback network produces a gain that is greater than that of the first closed-loop feedback network. The multi-loop voltage regulator also includes a load tracking compensation circuit configured to detect a load current, and to increase the gain of the second closed-loop feedback network based on a dominant pole in the second closed-loop feedback network being a function of the detected load current.

19 Claims, 7 Drawing Sheets

(56) References Cited

U.S. PATENT DOCUMENTS 7,268,524 B2 * 9/2007 Kase ..... G05F 1/575 323/282
7,843,180 B1 * 11/2010 Cilingiroglu ..... G05F 1/575 323/273
8,154,263 B1 * 4/2012 Shi ..... G05F 1/575 323/269
8,674,672 B1 * 3/2014 Johal ..... G05F 1/575 323/275
8,816,658 B1 * 8/2014 De Vita ..... G05F 1/575 323/275
9,588,541 B1 * 3/2017 Ho ..... G05F 3/267
9,874,889 B1 * 1/2018 Zhao ..... G05F 1/575
9,891,644 B1 * 2/2018 Ming ..... G05F 1/575
2003/0111986 A1 * 6/2003 Xi ..... G05F 1/575 323/280
2003/0128489 A1 * 7/2003 Katoh ..... G05F 1/575 361/93.9
2003/0178978 A1 * 9/2003 Biagi ..... G05F 1/575 323/282
2003/0214275 A1 * 11/2003 Biagi ..... G05F 1/575 323/280
2004/0004468 A1 * 1/2004 Dearn ..... G05F 1/575 323/280
2008/0157735 A1 * 7/2008 Liu ..... G05F 1/575 323/280
2009/0001953 A1 * 1/2009 Huang ..... G05F 1/575 323/281
2011/0025280 A1 * 2/2011 Kimura ..... G05F 1/575 323/282
2013/0082672 A1 * 4/2013 Kim ..... G05F 1/575 323/280
2014/0191739 A1 * 7/2014 Kim ..... G05F 1/56 323/280
2014/0340058 A1 * 11/2014 Wang ..... H02M 1/15 323/268
2017/0017250 A1 * 1/2017 Peluso ..... G05F 1/575
2017/0315574 A1 * 11/2017 Brown ..... G05F 1/575
2017/0357278 A1 * 12/2017 Bernardon ..... G05F 1/575
2017/0371365 A1 * 12/2017 Kossel ..... G05F 1/575
2018/0024581 A1 * 1/2018 Sabbineni ..... G05F 1/595 323/267
2018/0120879 A1 * 5/2018 Du ..... G05F 1/575
2019/0086943 A1 * 3/2019 Namekawa ..... G05F 1/575
2019/0258282 A1 * 8/2019 Magod Ramakrishna ..... G05F 1/575
2019/0305679 A1 * 10/2019 Jiang ..... H02M 3/158
2020/0004281 A1 * 1/2020 Chao ..... H02M 3/156

* cited by examiner

MULTI-LOOP VOLTAGE REGULATOR WITH LOAD TRACKING COMPENSATION

TECHNICAL FIELD

The present disclosure relates generally to power management devices, and in particular, to multi-loop voltage regulator with load tracking compensation.

BACKGROUND

Wireless communication technology has advanced rapidly over the past few years. One of the most promising areas for the use of wireless technology relates to communications between input/output devices and their "host" computers. For example, wireless keyboards and mice now couple via wireless connections to their host computers. These "wireless" input devices are highly desirable since they do not require any hard-wired connections with their host computers. However, the lack of a wired connection also requires that the wireless input devices contain their own power supply, i.e., that they be battery powered. In order to extend the life of their batteries the wireless input devices often support wireless charging. Some techniques for wireless charging, however, can cause degradation in power conversion efficiency and significant increase in design complexity and chip area.

BRIEF DESCRIPTION OF THE DRAWINGS

Certain features of the subject technology are set forth in the appended claims. However, for purpose of explanation, several embodiments of the subject technology are set forth in the following figures.

Certain features of the subject technology are set forth in the appended claims. However, for purpose of explanation, one or more implementations of the subject technology are set forth in the following figures.

DETAILED DESCRIPTION

Figure 1:
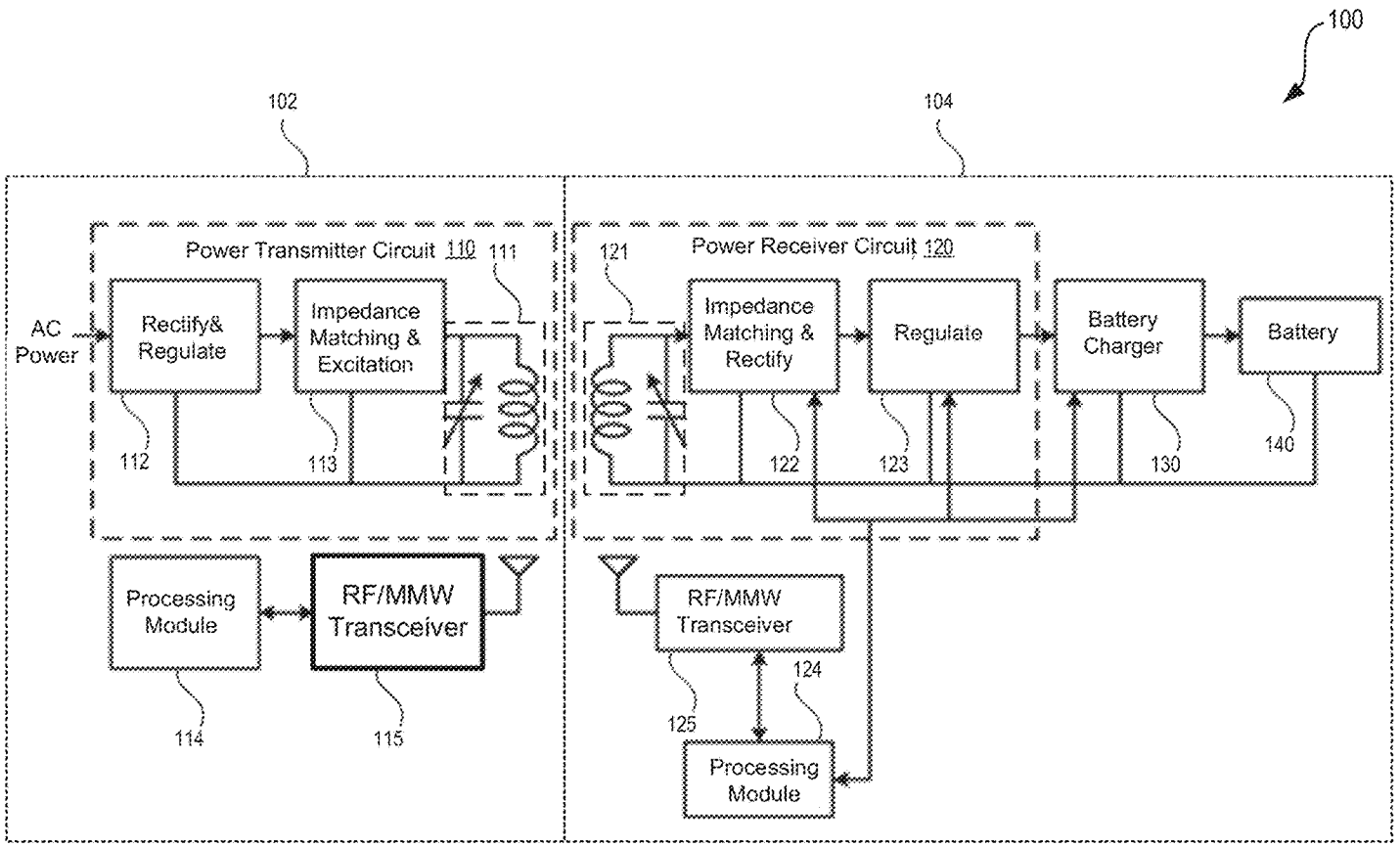
FIG. 1 is a schematic block diagram of an example of a portion of a wireless power system that includes a power transmitter circuit and a power receiver circuit in accordance with one or more implementations of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, the subject technology is not limited to the specific details set forth herein and may be practiced using one or more implementations. In one or more instances, structures and components are shown in block diagram form in order to avoid obscuring the concepts of the subject technology.

A DC linear voltage regulator, such as a low-dropout (LDO) regulator can regulate an output voltage even when the supply voltage is very close to the output voltage. There are two types of LDO regulators, namely a p-channel metal-oxide-semiconductor (PMOS) LDO and an n-channel metal-oxide-semiconductor (NMOS) LDO. The standard way to implement the PMOS LDO suffers from narrow load current range and low stability margin (e.g., <45 degrees), and the standard way to implement the NMOS LDO suffers from narrow output range or large noise and area.

The subject technology includes: 1) employing a low-gain high-speed inner loop to emulate an NMOS device in small signal behavior. This allows the output voltage of the voltage regulator to track a control voltage (derived from a comparison between a reference voltage and a feedback of the output voltage) without excessive delay. The subject technology includes 2) employing an actual PMOS device as a pass device to extend the output voltage range. The subject technology includes 3) a high gain outer loop to improve DC regulation at any load condition. The subject technology includes a dominant pole in the high gain outer loop that is an arbitrary linear function of the square root of the load current. The subject technology includes 4) a zero tracking loop (e.g., load tracking compensator) incorporated with the dual loop architecture (e.g., inner loop and outer loop), thus improving the stability margins of the voltage regulator. The load tracking compensator is incorporated with active lag compensation, thus reducing the area. Alternatively, the subject technology includes 5) a zero tracking loop incorporated with Miller compensation, thus reducing the area.

The subject technology provides improvement in power conversion efficiency that significantly extends battery life. The subject technology provides reduction of voltage ripple that relaxes the supply rejection requirements of downstream circuits. The subject technology eliminates the need for a charge pump compared to conventional systems. For example, the subject technology provides for a high performance, high accuracy, wide load range, full output range LDO without using a charge pump. The stability and DC regulation performance of the subject technology outperforms a traditional PMOS LDO. The output voltage range of the subject technology is wider than the NMOS LDO without a charge pump, while the noise performance and area cost of the subject technology is significantly better than the NMOS LDO with a charge pump.

FIG. 1 is a schematic block diagram of an example of a portion of a wireless power system 100 that includes a power transmitter circuit 110 and a power receiver circuit 120 in accordance with one or more implementations of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

The wireless power system 100 includes electronic devices 102 and 104. The electronic devices 102 and 104 may communicate with one another using one or more wireless communication technologies, such as Wi-Fi (e.g. 802.11ac, 802.11ax, etc.), cellular (e.g. 3G, 4G, LTE, 5G, etc.), directional multi-gigabit (DMG), and/or mmWave (e.g. 802.11ad, 802.11ay, etc.). In some implementations, the electronic devices 102 and 104 may communicate with one another for wireless charging. The electronic devices 102 and 104 may be in physical contact with one another for the wireless charging in some implementations, or may be physically separated from one another for the wireless charging in other implementations. The electronic devices 102 and 104 may be, for example, portable computing devices such as laptop computers, smartphones, tablet devices, wearable devices such as a watch, a band, and the like, or any other appropriate device that includes, for example, one or more wireless interfaces.

The power transmitter circuit 110 includes an LC circuit (e.g., a coil in parallel to an inductor) 111, a rectify and regulate circuit 112, an impedance matching and excitation circuit 113, a processing module 114, and an RF transceiver 115. The power receiver circuit 120 includes an LC circuit 121, an impedance matching and rectify circuit 122, a regulation circuit 123, a processing module 124, and an RF transceiver 125. The power receiver circuit 120 is coupled to a battery charger 130 and the processing module 124. The battery charger 130 is coupled to a battery 140. In this regard, the power receiver circuit 120 is readily integrated into an electronic device and uses components of the electronic device (e.g., the processing module 124). As such, the power receiver circuit 120 is not a standalone component coupled to the electronic device, but an integral part of the electronic device. In some aspects, the electronic device includes a housing, which houses the power receiver circuit 120, the battery charger 130, the battery 140, the RF transceiver 125, and the processing module 124 as shown in FIG. 1. As depicted in FIG. 1, the electronic device 102 is a wireless charger configured to provide power to the electronic device 104 through a wireless transmission, and the electronic device 104 is a wireless device, such as a smartphone, that receives the power from the electronic device 102 through the wireless transmission and charges the battery 140 of the electronic device 104.

In an example of operation, the rectify and regulate circuit 112 of the power transceiver circuit 110 converts an AC voltage into a DC voltage. The impedance matching and excitation circuit 113 couples the TX power coil to the DC voltage in an alternating pattern (e.g., a full bridge inverter, a half bridge inverter) at a given frequency (e.g., 10 MHz, etc.). The impedance matching allows the LC circuit 111 to be tuned to a desired resonant frequency and to have a desired quality factor. For example, the LC circuit 111 may be tuned to resonant at an excitation rate.

The coil of the LC circuit 121 is proximal to the coil of the LC circuit 111 to receive the magnetic field created by the TX coil and to create an AC voltage therefrom. The LC circuit 121 may be tuned to have a desired resonance and/or a desired quality factor. The impedance matching and rectify circuit 122 rectifies the AC voltage of the RX coil to produce a DC rail voltage that is regulated via the regulation circuit 123.

Figure 2A:
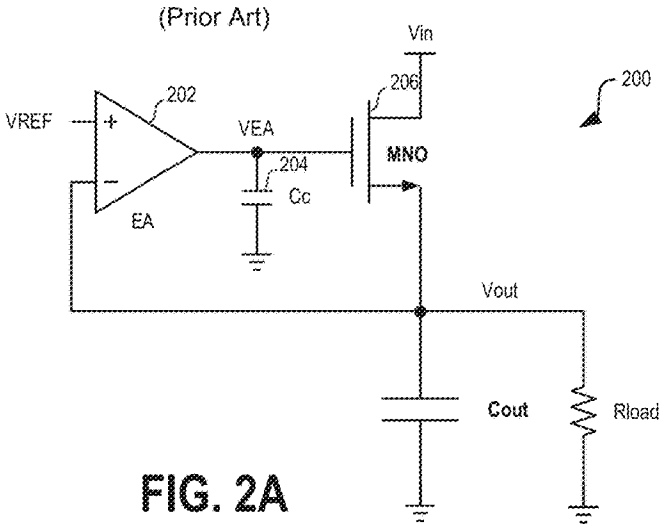
FIG. 2A is a schematic diagram illustrating an example of a conventional voltage regulator with an n-channel transistor.

FIG. 2A is a schematic diagram illustrating an example of a conventional NMOS-based voltage regulator 200. The NMOS-based voltage regulator 200 includes an error amplifier 202 ("EA"), a compensation capacitor 204 ("Cc"), and an NMOS transistor 206 ("MNO"). The NMOS transistor 206 is used as the pass device. The output impedance of the NMOS-based voltage regulator 200 is typically much smaller than that of the error amplifier 202. The NMOS-based voltage regulator 200 can be simply stabilized by placing an on-chip compensation capacitor, such as the compensation capacitor 204, at the output of the error amplifier 202. However, since the highest voltage at the output node ("VEA") of the error amplifier 202 can reach is equal to an input voltage ("Vin"), and since the gate voltage of the NMOS transistor 206 has a threshold voltage (e.g., Vth~0.7V) higher than the source voltage to ensure proper operation, the maximum output voltage of the NMOS-based voltage regulator 200 ("Vout") may not exceed Vin−Vth, which significantly limits the output voltage range of the NMOS-based voltage regulator 200 and reduces system power efficiency.

Figure 2B:
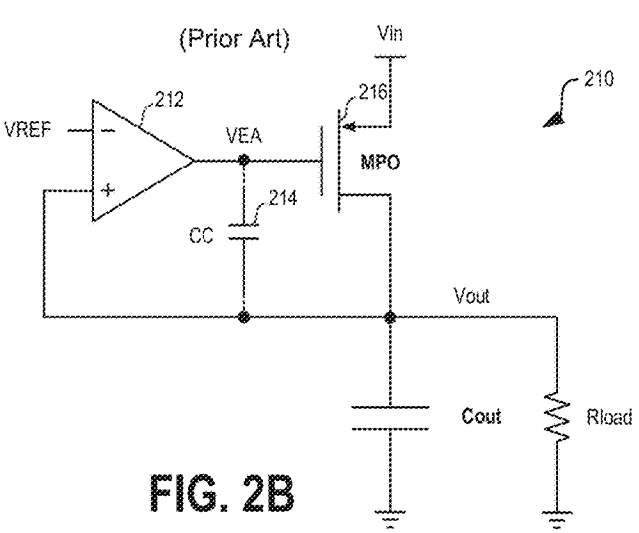
FIG. 2B is a schematic diagram illustrating an example of a conventional voltage regulator with a p-channel transistor.

FIG. 2B is a schematic diagram illustrating an example of a conventional PMOS-based voltage regulator 210. The PMOS-based voltage regulator 210 includes an error amplifier 212 ("EA"), a compensation capacitor 214 ("Cc"), and a PMOS transistor 216 ("MPO"). The PMOS transistor 216 is used as the pass device. Since the input voltage of the PMOS-based voltage regulator 210 ("Vin") is typically more than a threshold voltage ("Vth") higher than the ground rail, the output voltage ("Vout") of the PMOS-based voltage regulator 210 can be regulated to a wide range of reference voltage (i.e., between nearly Vin and ground rail). However, since the output resistance of the PMOS-based voltage regulator 210 is close to the output impedance of the error amplifier 212. A large compensation capacitor, such as the compensation capacitor 214, is needed on node VEA to make the pole at the output of the error amplifier 212 the dominant pole to stabilize the PMOS-based voltage regulator 210. This significantly increases the chip area and can negatively impact system performance. Alternatively, Miller compensation (i.e., placing the compensation capacitor 214 between the node Vout and the node VEA) can be used to reduce the output resistance of the PMOS-based voltage regulator 210 and magnify the equivalent capacitor on VEA. However, this makes the node VEA difficult to track Vin at higher frequencies, and thereby, significantly reduce the power supply rejection ratio (PSRR).

Figure 2C:
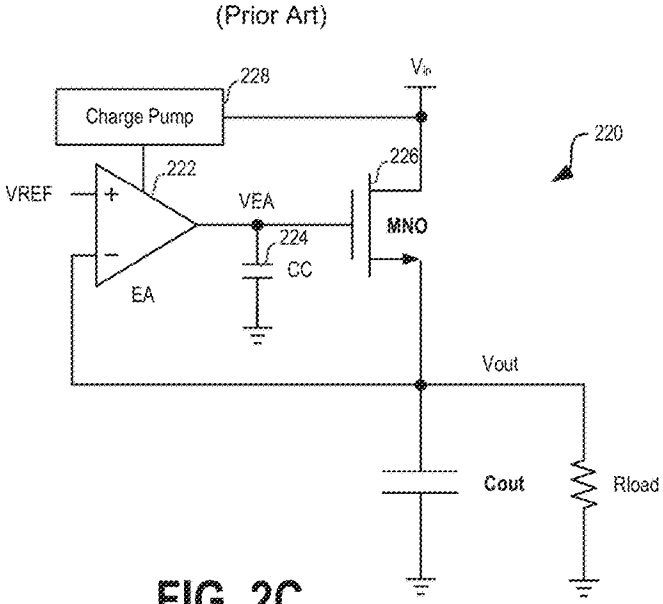
FIG. 2C is a schematic diagram illustrating an example of a conventional voltage regulator with an n-channel transistor and a charge pump.

FIG. 2C is a schematic diagram illustrating an example of a conventional NMOS-based voltage regulator 220 with a charge pump 228. The NMOS-based voltage regulator 220 includes an error amplifier 222 ("EA"), a compensation capacitor 224 ("Cc"), an NMOS transistor 226 ("MNO") and the charge pump 228. For the NMOS-based voltage regulator 220, the charge pump 228 is used to increase the maximum voltage of the error amplifier 222 output at node VEA in order to improve the output voltage range of the NMOS-based voltage regulator 220. However, this solution significantly increases the design complexity and chip area. In addition, the charge pump 228 introduces large switching noise and voltage ripple at the output of the NMOS-based voltage regulator 220, which degrades the performance of the NMOS-based voltage regulator 220.

Figure 2D:
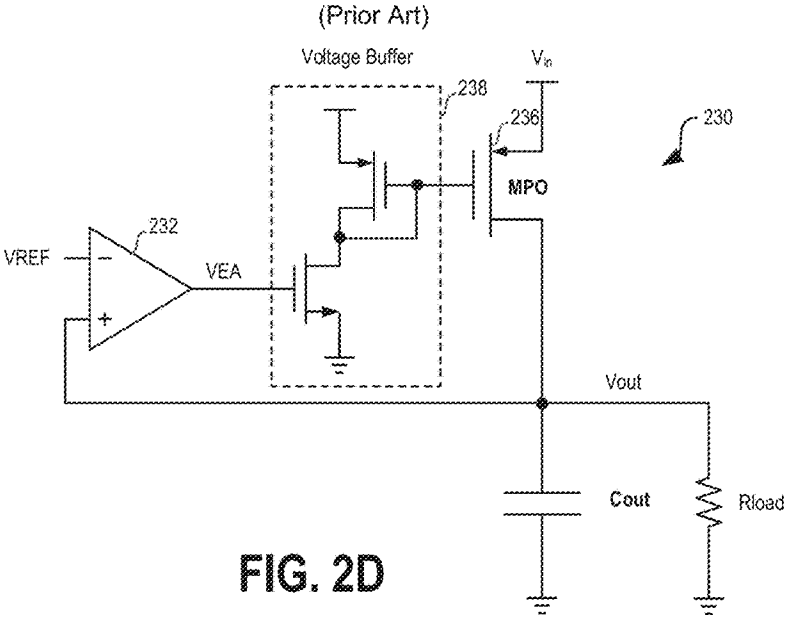
FIG. 2D is a schematic diagram illustrating an example of a conventional voltage regulator with a p-channel transistor and a voltage buffer.

FIG. 2D is a schematic diagram illustrating an example of a conventional PMOS-based voltage regulator 230 with a voltage buffer 238. The PMOS-based voltage regulator 230 includes an error amplifier 232 ("EA"), a PMOS transistor 236 ("MPO") and the voltage buffer 238. For the PMOS-based voltage regulator 230, the voltage buffer 238 is inserted between the error amplifier 232 and the PMOS transistor 236. This makes the pole at the error amplifier 232 output at node VEA and the pole at the voltage buffer 238 output into high frequency poles. The PMOS-based voltage regulator 230 is then stabilized by the dominant pole at the PMOS-based voltage regulator 230 output. However, when the load current is heavier or a smaller output capacitor is used, the pole at LDO output will move to a higher frequency (i.e., closer to the non-dominant poles). In order to stabilize the PMOS-based voltage regulator 230 in these scenarios, the DC gain of the PMOS-based voltage regulator 230 needs to be reduced. However, this reduces the DC accuracy of the PMOS-based voltage regulator 230. Alternatively, the non-dominant poles are located at significantly higher frequencies. However, this increases the quiescent current of the PMOS-based voltage regulator 230 and reduces the power conversion efficiency.

Figure 3:
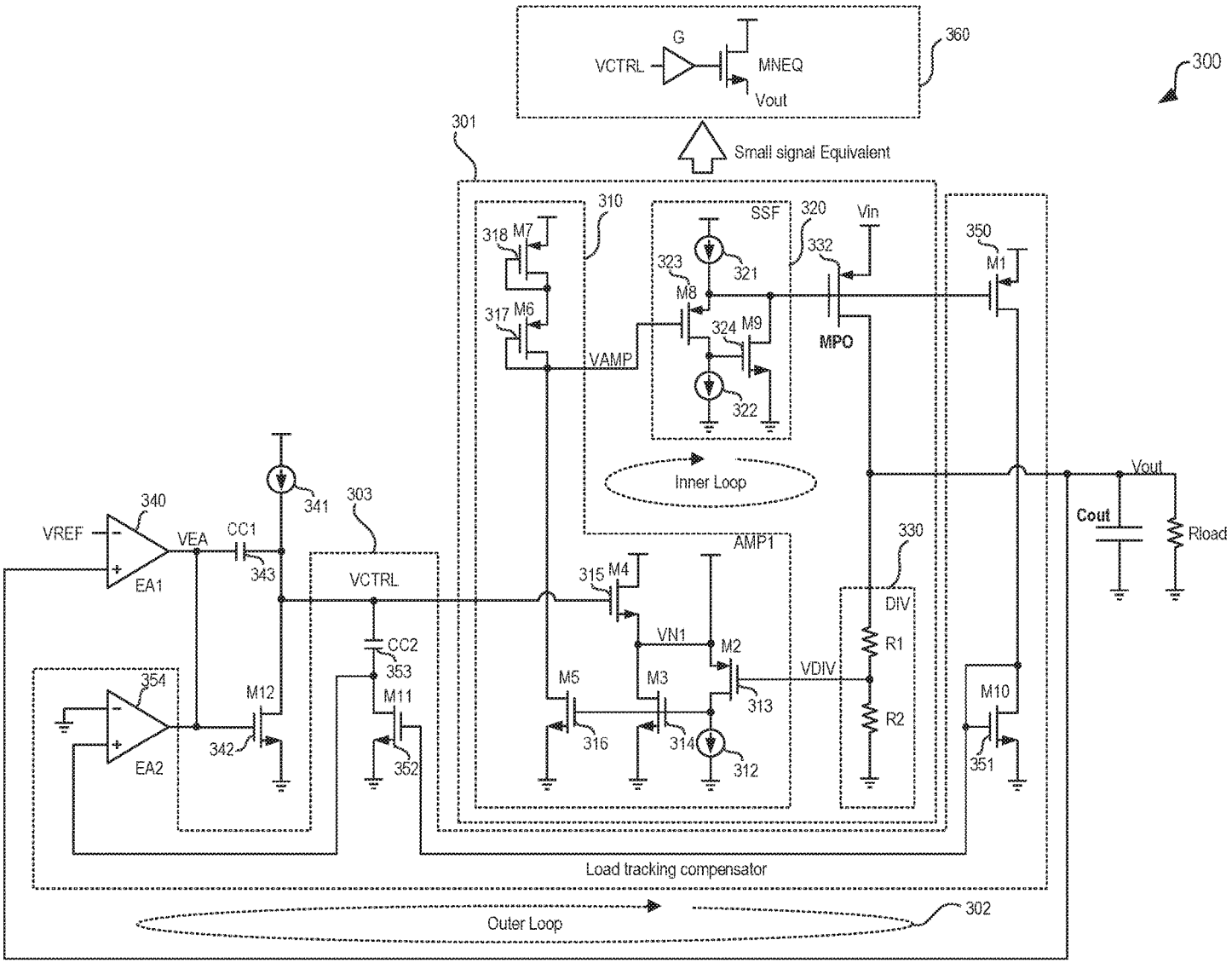
FIG. 3 is a schematic diagram illustrating an example of a multi-loop voltage regulator in accordance with one or more implementations of the subject technology.

FIG. 3 is a schematic diagram illustrating an example of a multi-loop voltage regulator 300 in accordance with one or more implementations of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

The multi-loop voltage regulator 300 includes an inner loop circuit 301, an outer loop circuit 302, and a load tracking compensation circuit 303. In some aspects, the inner loop circuit 301 is referred to as a first closed-loop feedback network and the outer loop circuit 302 is referred to as a second closed-loop feedback network. The inner loop circuit 301 includes an amplifier 310 ("AMP1"), a source follower 320 ("SSF"), a voltage divider 330 ("DIV"), and a pass device 332 ("MPO"). In some aspects, the amplifier 310 is referred to as a low-gain high-bandwidth amplifier and the source follower 320 is referred to as a super source follower buffer. The amplifier 310 includes a local feedback loop circuit, series-connected diodes, a transistor 315 ("M4") and a transistor 316 ("M5"). The local feedback loop circuit includes a current source 312, a transistor 313 ("M2") and a transistor 314 ("M3"). The series-connection diodes include a transistor 317 ("M6") and a transistor 318 ("M7"). The source follower includes a current source 321 and a current source 322, a transistor 323 ("M8") and a transistor 324 ("M9"). The voltage divider 330 includes a first resistor ("R1") and a second resistor ("R2").

In the local feedback loop circuit of the amplifier 310, a source terminal of the transistor 313 is coupled to a supply voltage. The gate terminal of the transistor 313 is coupled to a virtual node between the resistor R1 and the resistor R2 of the voltage divider 330. The drain terminal of the transistor 313 is coupled to a first terminal of the current source 312. The second terminal of the current source 312 is coupled to ground. The drain terminal of the transistor 315 is coupled to the supply voltage, and a source terminal of the transistor 315 is coupled to the source terminal of the transistor 313 and a drain terminal of the transistor 314 to form a local feedback loop. The drain terminal of the transistor 313 is also coupled to gate terminals of the transistor 314 and the transistor 316. The source terminals of the transistors 314 and 316 are coupled to ground.

The source terminal of the transistor 318 is coupled to the supply voltage and both gate terminal and drain terminal of the transistor 318 are tied to one another. The drain terminal of the transistor 318 is coupled to a source terminal of the transistor 317 and both gate terminal and drain terminal of the transistor 317 are tied to one another. The drain terminal of the transistor 317 is coupled to the drain terminal of the transistor 316.

The first terminal of the current source 321 is coupled to the supply voltage and a second terminal of the current source 321 is coupled to a source terminal of the transistor 323 and a drain terminal of the transistor 324. The drain terminal of the transistor 317 is coupled to a gate terminal of the transistor 323. The drain terminal of the transistor 323 is coupled to a gate terminal of the transistor 324 and to a first terminal of the current source 322. The second terminal of the current source 322 and a source terminal of the transistor 324 are coupled to ground. The second terminal of the current source 321 is also coupled to a gate terminal of the pass device 332. The source terminal of the pass device 332 is coupled to the supply voltage and a drain terminal of the pass device 332 is series connected with the first resistor R1 of the voltage divider 330.

The load tracking compensation circuit includes a transistor 350 ("M1"), a current mirror, a compensation capacitor 353 ("CC2"), and an error amplifier 354 ("EA2"). The source terminal of the transistor 350 is coupled to the supply voltage, and a gate terminal of the transistor 350 is coupled to the gate terminal of the pass device 332 and the second terminal of the current source 321. The current mirror includes a transistor 351 ("M10") and a transistor 352 ("M11"). The drain terminal of the transistor 350 is coupled to a drain terminal of the transistor 351 and to a gate terminal of the transistor 351. The gate terminal of the transistor 351 is coupled to a gate terminal of the transistor 352. The first terminal of the compensation capacitor 353 is coupled to a drain terminal of the transistor 352 and a second terminal of the compensation capacitor 353 is coupled to the gate terminal of the transistor 315. Source terminals of the transistor 351 and the transistor 352 are coupled to ground. The non-inverting input of the error amplifier 354 is coupled to the drain terminal of the transistor 352 and the first terminal of the compensation capacitor 353. The inverting input of the error amplifier 354 is coupled to ground.

The outer loop circuit 302 includes an error amplifier 340 ("EA1"), a current source 341, a transistor 342 ("M12"), and a compensation capacitor 343 ("CC1"). The non-inverting input of the error amplifier 340 is coupled to the drain terminal of the pass device 332 and the output terminal. The inverting input of the error amplifier 340 is coupled to a reference voltage ("VREF"). The first terminal of the compensation capacitor 343 is coupled to an output of the error amplifier 340, and a second terminal of the compensation capacitor 343 is coupled to the drain terminal of the transistor 342. The drain terminal of the transistor 342 is coupled to the gate terminal of the transistor 315. The output of the error amplifier 340 and the output of the error amplifier 354 are each coupled to a gate terminal of the transistor 342.

In some aspects, a transfer function representation of the inner loop circuit 301 includes a first pole at a gate terminal of the pass device 332 and a second pole at a gate terminal of the transistor 323 of the source follower 320. In some aspects, a transfer function representation of the multi-loop voltage regulator 300 includes a third pole at the output terminal of the multi-loop voltage regulator 300 that is proportional to a square root of the load current. In some aspects, a transfer function representation of the outer loop circuit 302 includes a fourth pole at an output of the error amplifier 340 and a fifth pole at a node between the first compensation capacitor 343 and the drain terminal of the transistor 342.

The inner loop circuit 301 has a lower open loop gain and behaves as a voltage follower such that the output voltage ("Vout") at the output terminal tracks changes in the control voltage ("VCTRL") without excessive delay. The amplifier 310 senses the scaled version of the output voltage ("VDIV") and generates an amplifier voltage signal ("VAMP") that is proportional to the scaled voltage signal VDIV at the input of the source follower 320. The output voltage of the source follower 320 tracks the amplifier voltage signal VAMP, but the output impedance of the source follower 320 is significantly lower than that of the amplifier 310, which pushes the pole at the gate of the pass device 332 to a much higher frequency. As depicted in FIG. 3, the pass device 332 is a p-channel transistor. In some aspects, the small-signal closed-loop transfer function of the inner loop circuit 301 is approximately equivalent to a wide-band voltage buffer followed by a NMOS transistor ("MNEQ"), where the DC gain of the voltage buffer can be expressed by: $G=(R_1+R_2)/R_2$. The transconductance of the NMOS transistor MNEQ is equivalent to a transconductance of the pass device 332.

The inner loop circuit 301 is configured to receive a supply voltage ("Vin") from a power supply and drive an output voltage ("Vout") that is smaller than the supply voltage to a load. The outer loop circuit 302 is connected to the inner loop circuit 301 and is configured to regulate the output voltage between a first supply voltage rail and a second supply voltage rail for a given load current. The outer loop circuit 302 has a higher open loop gain than the inner loop circuit 301, and the outer loop circuit 302 accurately regulates the output voltage Vout at any load condition. The load tracking compensation circuit 303 is incorporated with dual loop architecture (e.g., the inner loop circuit 301 and the outer loop circuit 302) to improve the stability margin, output voltage range and DC regulation. As depicted in FIG. 3, the load tracking compensation circuit 303 is incorporated with active-lag compensation to improve the gain of the outer loop circuit 302 without scarifying the stability or noise performance. The dominate pole in the outer loop circuit 302 can be an arbitrary linear function of the square root of the load current, which further improves the stability.

In the amplifier 310, the transistor 313 ("M2") and the transistor 314 ("M3") form a local feedback loop, which ensures the node VN1 (e.g., located between the drain terminal of the transistor 314 and the source terminal of the transistor 313) to closely track the scaled voltage signal VDIV. Thus, the transconductance of the amplifier 310 is equivalent to the transconductance of the transistor 315 ("M4"). Since transistor M6 and M7 are connected as two stacked diodes, the output conductance of the amplifier AMP1 is approximately half of the transconductance of M6. Therefore, the gain of AMP1 is a constant across a wide range of load current and frequency.

The choice of the sensing topology of the amplifier 310 ensures the scaled voltage signal VDIV to be approximately two threshold voltage (Vth) below the control voltage VCTRL, which allows the output voltage Vout to be regulated rail to rail (e.g., between a first supply voltage rail and a second supply voltage rail).

Due to the local feedback formed by the transistor 313 ("M2") and the transistor 314 ("M3") as well as the diode connection of the transistor 317 ("M6") and the transistor 318 ("M7"), there are no high-impedance nodes present in the amplifier 310.

The super source follower formed by the transistor 323 ("M8") and the transistor 324 ("M9") has very low input capacitance and output resistance. This pushes the poles at the gate terminal of the pass device 332 and the output of the amplifier 310 to a significantly higher frequency than the pole at the output terminal of the multi-loop voltage regulator 300, which ensures the stability of the inner loop circuit 301.

In some implementations, the outer loop circuit 302 employs active lag compensation by placing the compensation capacitor 343 ("CC1") across the drain terminal and the gate terminal of the transistor 342 ("M12"). This ensures that the pole at the output node ("VEA") of the error amplifier 340 ("EA1") is located at a frequency that is significantly lower than that of the pole at the node VCTRL.

Since the small signal model for the inner loop circuit 301 of the multi-loop voltage regulator 300 can be approximated as an NMOS transistor, the pole at the output terminal of the multi-loop voltage regulator 300 is also located at a much higher frequency than the pole at the output node VEA of the error amplifier 340. Therefore, only one low frequency pole is present in the outer loop circuit 302, which improves the stability.

The frequency of the pole at the output terminal of the multi-loop voltage regulator 300 is proportional to the square root of the load current. In the load tracking compensation circuit 303, the transistor 352 ("M11") and the compensation capacitor 353 ("CC2") are employed to generate a compensation zero for the purpose of improving the stability of the multi-loop voltage regulator 300. Since the gate voltage at the gate terminal of the transistor 352 and thus the on resistance of the transistor 352 is also proportional to the square root of the load current, the pole at the output terminal of the multi-loop voltage regulator 300 can be cancelled by the compensation zero at any load condition.

The load tracking compensation circuit 303 is configured to detect a load current, and to adjust the gain of the outer loop circuit 302 based on a dominant pole in the outer loop circuit 302 that is a function of the load current. In some implementations, the load tracking compensation circuit 303 is introduced to the outer loop circuit 302 indirectly through an auxiliary transconductance error amplifier ("EA2"), namely the error amplifier 354, for two reasons: 1) the source terminal and drain terminal of the load tracking transistor M12, namely the transistor 342, is referred to ground, which simplifies the circuit topology of the multi-loop voltage regulator 300; and 2) the load tracking compensation circuit 303 enhances the active lag compensation by introducing a load dependent term to the dominant pole in the outer loop circuit 302. Since many high-order poles (which degrades the stability) are also load dependent, having the dominant pole as a function of load current further improves the loop stability.

Figure 4:
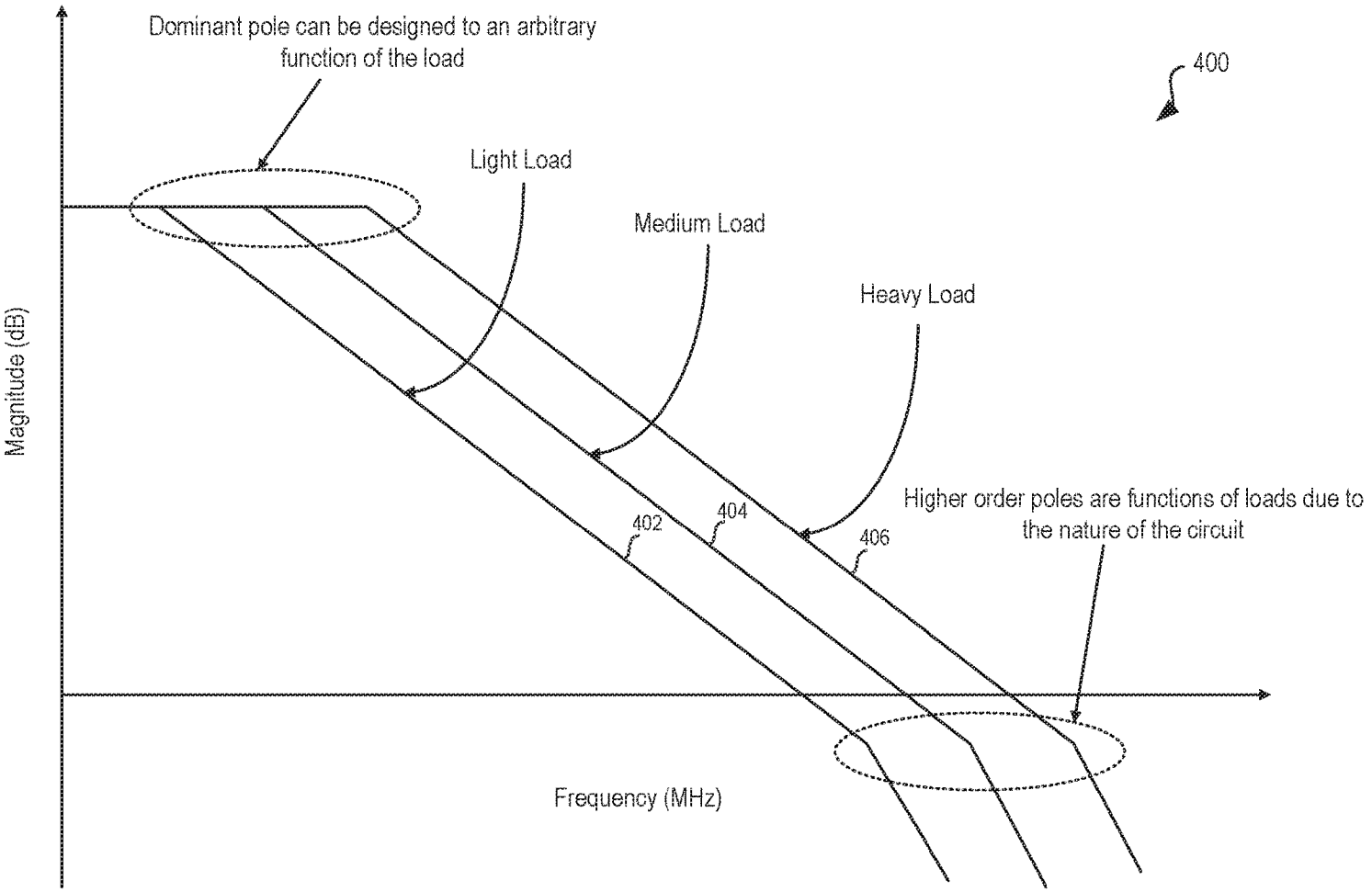
FIG. 4 is a plot illustrating voltage regulation magnitude as a function of frequency for different loads in accordance with one or more implementations of the subject technology.

FIG. 4 is a plot 400 illustrating voltage regulation magnitude as a function of frequency for different loads in accordance with one or more implementations of the subject technology. The plot 400 includes magnitude measurements (e.g., dB) of a light load curve 402, a medium load curve 404, and a heavy load curve 406 as a function of frequency (e.g., MHz). The load tracking compensation circuit 303 is incorporated with the dual loop architecture to improve the stability margin, output voltage range and DC regulation of the multi-loop voltage regulator 300. The load tracking compensation circuit 303 is also incorporated with active lag compensation (via the transistor 342 ("M12") and the compensation capacitor 343 ("CC1")) to improve the voltage regulation by the outer loop circuit 302 without scarifying stability or noise performance. In some aspects, the load tracking compensation circuit 303 enhances the active lag compensation by introducing a load dependent term to the dominant pole in the outer loop circuit 302. As depicted in FIG. 4, the dominant pole can be designed to an arbitrary function of the load, and higher order poles are functions of the varying loads (e.g., light, medium, heavy) due to the circuit topology. In this case, the dominant pole is located at lower frequencies, whereas non-dominant poles are located at higher frequencies.

Figure 5:
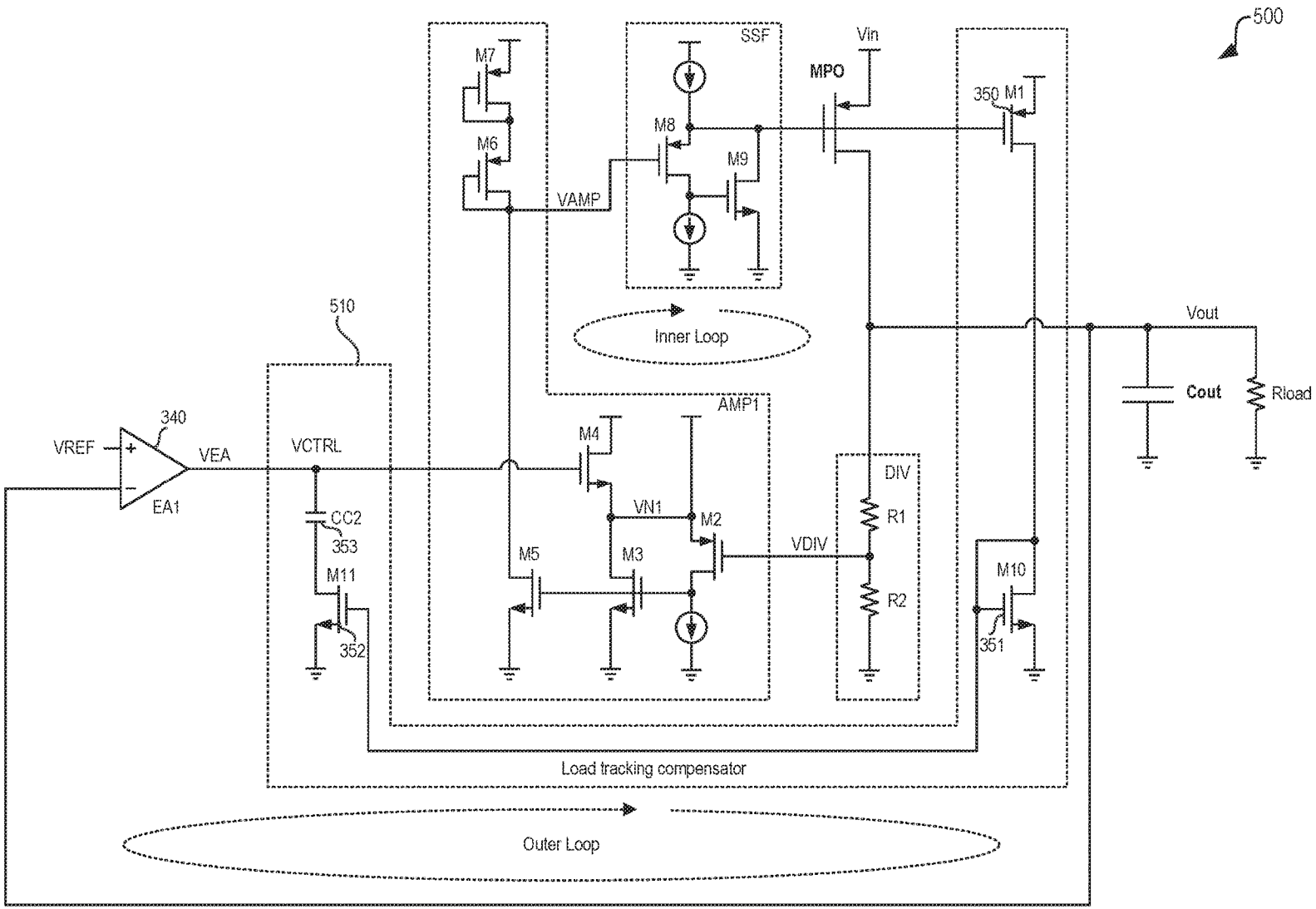
FIG. 5 is a schematic diagram illustrating an example of a multi-loop voltage regulator having a load tracking compensation circuit with passive lag compensation in accordance with one or more implementations of the subject technology.

FIG. 5 is a schematic diagram illustrating an example of a multi-loop voltage regulator 500 having a load tracking compensation circuit 510 with passive lag compensation in accordance with one or more implementations of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

In comparison to the multi-loop voltage regulator 300 of FIG. 3, the load tracking compensation circuit 510 is incorporated with passive lag compensation without using an additional amplifier, such as an auxiliary transconductance error amplifier. The load tracking compensation circuit 510 includes a transistor 350, a current mirror, and a compensation capacitor 353. The current mirror includes a transistor 351 and a transistor 352.

The source terminal of the transistor 350 is coupled to the supply voltage, and a gate terminal of the transistor 350 is coupled to the gate terminal of the pass device 332 and the second terminal of the current source 321. The current mirror includes a transistor 351 ("M10") and a transistor 352 ("M11"). The drain terminal of the transistor 350 is coupled to a drain terminal of the transistor 351 and to a gate terminal of the transistor 351. The gate terminal of the transistor 351 is coupled to a gate terminal of the transistor 352. The first terminal of the compensation capacitor 353 ("CC2") is coupled to a drain terminal of the transistor 352, and a second terminal of the compensation capacitor 353 is coupled to the gate terminal of the transistor 315 ("M4"). Source terminals of the transistor 351 and the transistor 352 are coupled to ground.

The outer loop circuit includes an error amplifier 340 ("EA1"). The load tracking compensation circuit 510 omits an error amplifier compared to the load tracking compensation circuit 303 of FIG. 3. In this regard, the output of the error amplifier 340 is coupled directly to the second terminal of the compensation capacitor 353.

The compensation zero introduced by the load tracking compensation circuit 510 can track the pole at the output terminal ("Vout") of the multi-loop voltage regulator 500 to improve the stability. This implementation simplifies the circuit topology compared to the multi-loop voltage regulator 300 of FIG. 3 by eliminating one amplifier, namely the error amplifier 354. However, the dominant pole of the multi-loop voltage regulator 500 is no longer a function of the load current.

Figure 6:
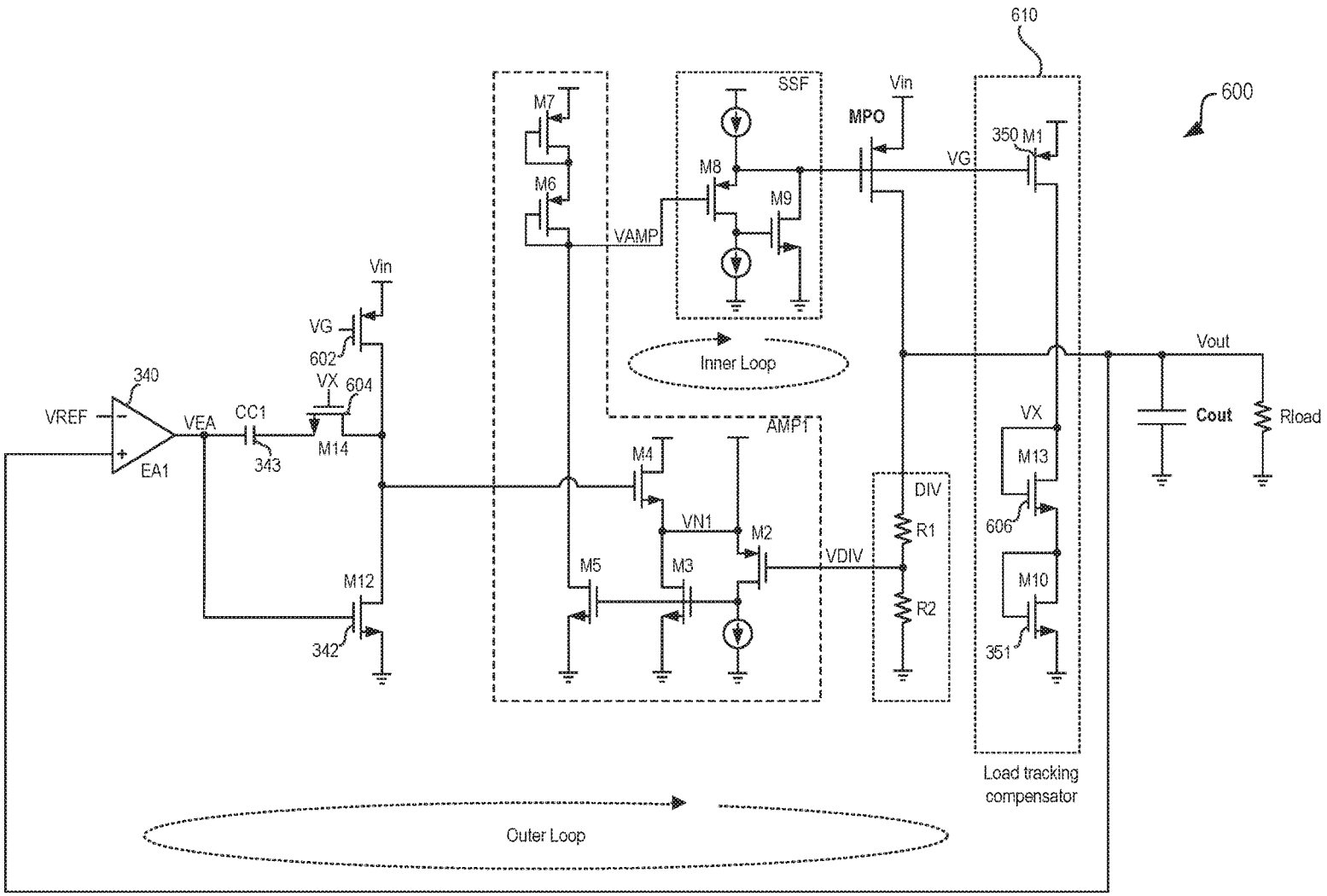
FIG. 6 is a schematic diagram illustrating an example of a multi-loop voltage regulator having a load tracking compensation circuit with active lag compensation in accordance with one or more implementations of the subject technology.

FIG. 6 is a schematic diagram illustrating an example of a multi-loop voltage regulator 600 having a load tracking compensation circuit with active lag compensation in accordance with one or more implementations of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

In comparison to the multi-loop voltage regulator 300 of FIG. 3, the load tracking compensation circuit 610 is incorporated with active lag compensation without using an additional amplifier, such as an auxiliary transconductance error amplifier. In some aspects, employing active lag compensation helps improve loop gain without introducing additional noise. As depicted in FIG. 6, the load tracking compensation circuit 610 includes a transistor 350, a transistor 606, and a third transistor 351.

The source terminal of the transistor 350 is coupled to the supply voltage, and a gate terminal of the transistor 350 is coupled to the gate terminal of the pass device 332 and the second terminal of the current source 321. The drain terminal of the transistor 350 is coupled to a drain terminal of the transistor 606 and to a gate terminal of the transistor 606. The source terminal of the transistor 606 is coupled to a drain terminal of the transistor 351 and to a gate terminal of the transistor 351. The source terminal of the transistor 351 is coupled to ground.

The outer loop circuit includes an error amplifier 340, a transistor 342, a transistor 602, a pass device 604, and a compensation capacitor 343. The non-inverting input of the error amplifier 340 is coupled to the drain terminal of the pass device 332 and the output terminal ("Vout"). The inverting input of the error amplifier 340 is coupled to a reference voltage ("VREF"). The first terminal of the compensation capacitor 343 is coupled to an output of the error amplifier 340. The output of the error amplifier 340 is also coupled to the gate terminal of the transistor 342. The source terminal of the pass device 604 is coupled to a second terminal of the compensation capacitor 343. The drain terminal of the pass device 604 is coupled to the drain terminal of the transistor 602, which in turn is coupled to the gate terminal of the transistor 315 ("M4"). The source terminal of the transistor 602 is coupled to an input supply voltage ("Vin"). In some aspects, the gate terminal of the transistor 602 is biased by a first voltage signal ("VG"). The first voltage signal VG is produced at the drain terminal of the transistor 324 ("M9"). In some aspects, the gate terminal of the pass device 604 is biased by a voltage signal ("VX"). The second voltage signal VX is produced at the drain terminal of the transistor 606 ("M13").

The compensation zero introduced by the load tracking compensation circuit 610 can track the pole at the output terminal ("Vout") of the multi-loop voltage regulator 600 with a simple circuit implementation. This implementation simplifies the circuit topology compared to the multi-loop voltage regulator 300 of FIG. 3 by eliminating one amplifier, namely the error amplifier 354. However, the dominant pole of the multi-loop voltage regulator 600 is no longer a function of the load current.

Figure 7:
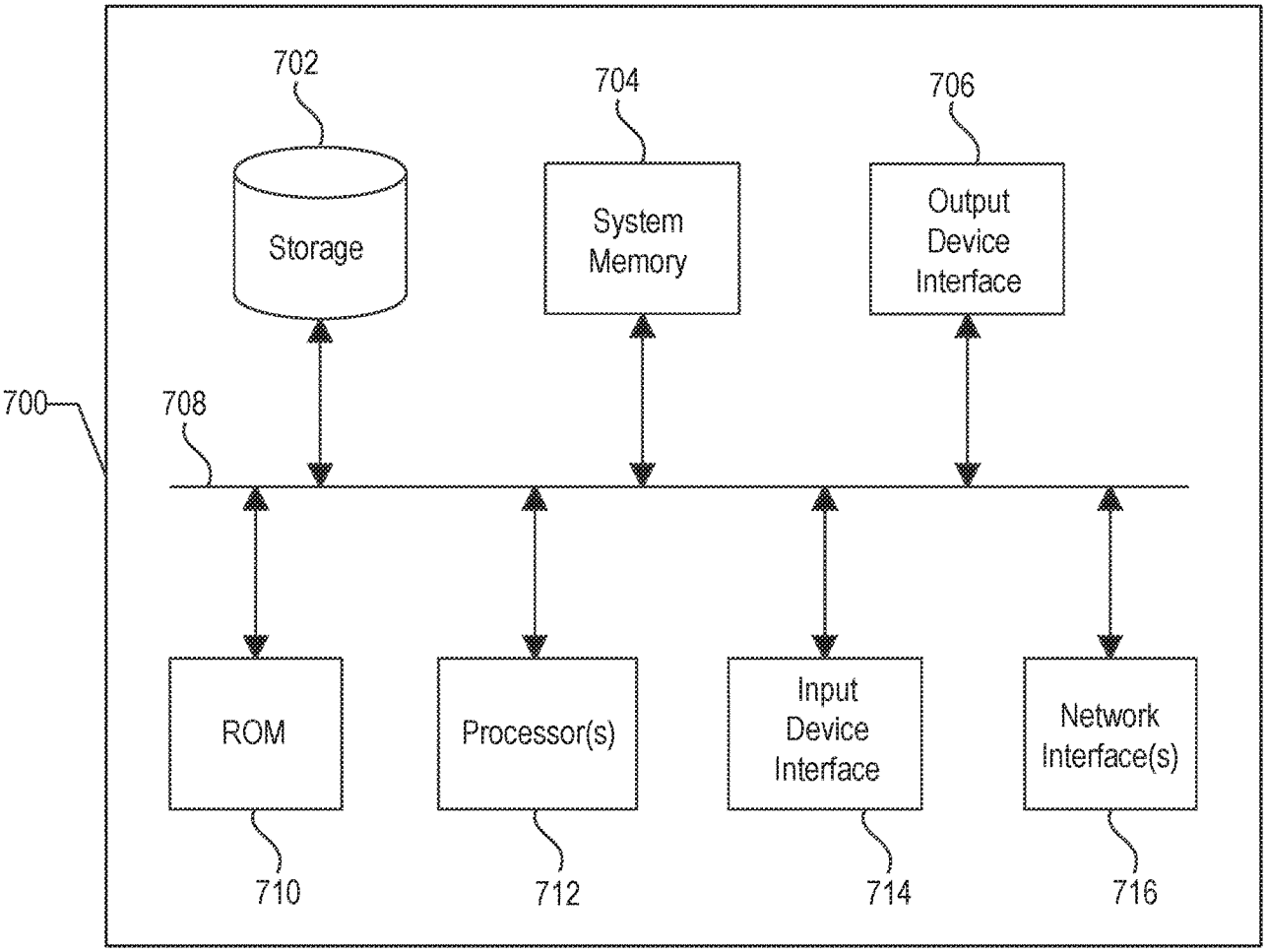
FIG. 7 conceptually illustrates an electronic system with which any implementations of the subject technology are implemented.

FIG. 7 conceptually illustrates an electronic system 700 with which one or more implementations of the subject technology may be implemented. The electronic system 700, for example, can be a network device, a media converter, a desktop computer, a laptop computer, a tablet computer, a server, a switch, a router, a base station, a receiver, a phone, or generally any electronic device that transmits signals over a network. Such an electronic system 700 includes various types of computer readable media and interfaces for various other types of computer readable media. In one or more implementations, the electronic system 700 is, or includes, one or more of the electronic devices 102 and 104. The electronic system 700 includes a bus 708, one or more processing unit(s) 712, a system memory 704, a read-only memory (ROM) 710, a permanent storage device 702, an input device interface 714, an output device interface 706, and a network interface 716, or subsets and variations thereof.

The bus 708 collectively represents all system, peripheral, and chipset buses that communicatively connect the numerous internal devices of the electronic system 700. In one or more implementations, the bus 708 communicatively connects the one or more processing unit(s) 712 with the ROM 710, the system memory 704, and the permanent storage device 702. From these various memory units, the one or more processing unit(s) 712 retrieves instructions to execute and data to process in order to execute the processes of the subject disclosure. The one or more processing unit(s) 712 can be a single processor or a multi-core processor in different implementations.

The ROM 710 stores static data and instructions that are needed by the one or more processing unit(s) 712 and other modules of the electronic system. The permanent storage device 702, on the other hand, is a read-and-write memory device. The permanent storage device 702 is a non-volatile memory unit that stores instructions and data even when the electronic system 700 is off. One or more implementations of the subject disclosure use a mass-storage device (such as a magnetic or optical disk and its corresponding disk drive) as the permanent storage device 702.

Other implementations use a removable storage device (such as a floppy disk, flash drive, and its corresponding disk drive) as the permanent storage device 702. Like the permanent storage device 702, the system memory 704 is a read-and-write memory device. However, unlike the permanent storage device 702, the system memory 704 is a volatile read-and-write memory, such as random access memory. System memory 704 stores any of the instructions and data that the one or more processing unit(s) 712 needs at runtime. In one or more implementations, the processes of the subject disclosure are stored in the system memory 704, the permanent storage device 702, and/or the ROM 710. From these various memory units, the one or more processing unit(s) 712 retrieves instructions to execute and data to process in order to execute the processes of one or more implementations.

The bus 708 also connects to the input device interface 714 and the output device interface 706. The input device interface 714 enables a user to communicate information and select commands to the electronic system. Input devices used with the input device interface 714 include, for example, alphanumeric keyboards and pointing devices (also called "cursor control devices"). The output device interface 706 enables, for example, the display of images generated by the electronic system 700. Output devices used with the output device interface 706 include, for example, printers and display devices, such as a liquid crystal display (LCD), a light emitting diode (LED) display, an organic light emitting diode (OLED) display, a flexible display, a flat panel display, a solid state display, a projector, or any other device for outputting information. One or more implementations include devices that function as both input and output devices, such as a touchscreen. In these implementations, feedback provided to the user can be any form of sensory feedback, such as visual feedback, auditory feedback, or tactile feedback; and input from the user can be received in any form, including acoustic, speech, or tactile input.

Finally, as shown in FIG. 7, the bus 708 also couples the electronic system 700 to one or more networks (not shown) through one or more network interfaces 716. In this manner, the computer can be a part of one or more network of computers (such as a local area network ("LAN"), a wide area network ("WAN"), or an Intranet, or a network of networks, such as the Internet. Any or all components of the electronic system 700 can be used in conjunction with the subject disclosure.

Implementations within the scope of the present disclosure can be partially or entirely realized using a tangible computer-readable storage medium (or multiple tangible computer-readable storage media of one or more types) encoding one or more instructions. The tangible computer-readable storage medium also can be non-transitory in nature.

The computer-readable storage medium can be any storage medium that can be read, written, or otherwise accessed by a general purpose or special purpose computing device, including any processing electronics and/or processing circuitry capable of executing instructions. For example, without limitation, the computer-readable medium can include any volatile semiconductor memory, such as RAM, DRAM, SRAM, T-RAM, Z-RAM, and TTRAM. The computer-readable medium also can include any non-volatile semiconductor memory, such as ROM, PROM, EPROM, EEPROM, NVRAM, flash, nvSRAM, FeRAM, FeTRAM, MRAM, PRAM, CBRAM, SONOS, RRAM, NRAM, racetrack memory, FJG, and Millipede memory.

Further, the computer-readable storage medium can include any non-semiconductor memory, such as optical disk storage, magnetic disk storage, magnetic tape, other magnetic storage devices, or any other medium capable of storing one or more instructions. In some implementations, the tangible computer-readable storage medium can be directly coupled to a computing device, while in other implementations, the tangible computer-readable storage medium can be indirectly coupled to a computing device, e.g., via one or more wired connections, one or more wireless connections, or any combination thereof.

Instructions can be directly executable or can be used to develop executable instructions. For example, instructions can be realized as executable or non-executable machine code or as instructions in a high-level language that can be compiled to produce executable or non-executable machine code. Further, instructions also can be realized as or can include data. Computer-executable instructions also can be organized in any format, including routines, subroutines, programs, data structures, objects, modules, applications, applets, functions, etc. As recognized by those of skill in the art, details including, but not limited to, the number, structure, sequence, and organization of instructions can vary significantly without varying the underlying logic, function, processing, and output.

While the above discussion primarily refers to microprocessor or multi-core processors that execute software, one or more implementations are performed by one or more integrated circuits, such as application specific integrated circuits (ASICs) or field programmable gate arrays (FPGAs). In one or more implementations, such integrated circuits execute instructions that are stored on the circuit itself.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order, or partitioned in a different way) all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

As used in this specification and any claims of this application, the terms "base station", "receiver", "computer", "server", "processor", and "memory" all refer to electronic or other technological devices. These terms exclude people or groups of people. For the purposes of the specification, the terms "display" or "displaying" means displaying on an electronic device.

As used herein, the phrase "at least one of" preceding a series of items, with the term "and" or "or" to separate any of the items, modifies the list as a whole, rather than each member of the list (e.g., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The predicate words "configured to", "operable to", and "programmed to" do not imply any particular tangible or intangible modification of a subject, but, rather, are intended to be used interchangeably. In one or more implementations, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The word "exemplary" is used herein to mean "serving as an example, instance, or illustration." Any embodiment described herein as "exemplary" or as an "example" is not necessarily to be construed as preferred or advantageous over other embodiments. Furthermore, to the extent that the term "include," "have," or the like is used in the description or the claims, such term is intended to be inclusive in a manner similar to the term "comprise" as "comprise" is interpreted when employed as a transitional word in a claim.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

What is claimed is:

1. A voltage regulator, comprising:

a first closed-loop feedback network configured to receive a supply voltage from a power supply and drive an output voltage that is smaller than the supply voltage to a load, wherein a transfer function representation of the first closed-loop feedback network includes a first pole and a second pole, and wherein the first pole has a frequency that is higher than that of the second pole;

a second closed-loop feedback network connected to the first closed-loop feedback network and configured to produce a control voltage based on a reference voltage and the output voltage and to regulate the output voltage between a first supply voltage rail and a second supply voltage rail for a given load current, wherein the second closed-loop feedback network produces a gain that is greater than that of the first closed-loop feedback network; and a load tracking compensation circuit configured to detect a load current, and to adjust the gain of the second closed-loop feedback network based on a dominant pole in the second closed-loop feedback network being a function of the load current, wherein the first closed-loop feedback network is configured to detect a change in the control voltage.

2. The voltage regulator of claim 1, wherein the first closed-loop feedback network comprises:

a pass device coupled to the power supply and to an output terminal of the voltage regulator;

a voltage divider coupled to a drain terminal of the pass device, wherein the voltage divider converts the output voltage into a scaled voltage that is smaller than the output voltage;

an amplifier coupled to the voltage divider and configured to receive the scaled voltage from the voltage divider and produce an amplifier voltage that is proportional to the scaled voltage; and a source follower coupled to the amplifier and to a gate terminal of the pass device, wherein the source follower produces a source follower voltage that tracks the amplifier voltage at an input to the source follower.

3. The voltage regulator of claim 2, wherein the scaled voltage is lesser than the control voltage by at least two threshold voltages of the pass device.

4. The voltage regulator of claim 2, wherein the source follower comprises:

a first current source coupled to a second supply voltage;

a first transistor coupled to an output of the amplifier and to the first current source;

a second transistor coupled across the first transistor and to the gate terminal of the pass device; and a second current source coupled to the first transistor and to the second transistor.

5. The voltage regulator of claim 4, wherein:

the source follower has an output impedance that is significantly smaller than an output impedance of the amplifier, and the transfer function representation of the first closed-loop feedback network includes the first pole at the gate terminal of the pass device and the second pole at a gate terminal of the first transistor of the source follower.

6. The voltage regulator of claim 5, wherein:

a transfer function representation of the voltage regulator includes a third pole at an output terminal of the voltage regulator that is proportional to a square root of the load current, and the first pole at the gate terminal of the pass device and the second pole at the gate terminal of the first transistor of the source follower are at frequencies that are higher than that of the third pole at the output terminal of the voltage regulator.

7. The voltage regulator of claim 4, wherein the amplifier comprises:

series-connected diodes coupled to an input to the source follower;

a third transistor coupled to the second supply voltage;

a fourth transistor coupled to the series-connected diodes; and a local feedback loop circuit coupled to the third transistor and to the fourth transistor and configured to produce a local feedback voltage that tracks the scaled voltage of the voltage divider.

8. The voltage regulator of claim 7, wherein the series-connection diodes comprise:

a fifth transistor coupled to a drain terminal of the fourth transistor and to a gate terminal of the first transistor of the source follower; and a sixth transistor coupled to the second supply voltage and to a source terminal of the fifth transistor, wherein a gate terminal of the sixth transistor is tied to a drain terminal of the sixth transistor.

9. The voltage regulator of claim 8, wherein the amplifier has a first transconductance that is approximately half of a second transconductance of the fifth transistor of the series-connected diodes.

10. The voltage regulator of claim 7, wherein the local feedback loop circuit comprises:

a seventh transistor coupled to the voltage divider and to a source terminal of the third transistor of the amplifier;

an eighth transistor coupled across the seventh transistor and to a gate terminal of the fourth transistor of the amplifier;

a first current source coupled to the second supply voltage and to a source terminal of the seventh transistor; and a second current source coupled to a drain terminal of the seventh transistor and to ground, wherein the local feedback voltage is coupled between a drain terminal of the eighth transistor and the source terminal of the seventh transistor.

11. The voltage regulator of claim 7, wherein the amplifier has a first transconductance that is equivalent to a second transconductance of the third transistor of the amplifier.

12. The voltage regulator of claim 2, wherein the second closed-loop feedback network comprises:

a ninth transistor coupled to the amplifier;

a current source coupled to a second supply voltage and to a drain terminal of the ninth transistor;

a first compensation capacitor coupled to the drain terminal and a gate terminal of the ninth transistor to employ active lag compensation in the second closed-loop feedback network; and a first error amplifier coupled to the first compensation capacitor and to a gate terminal of the ninth transistor and configured to drive the control voltage to the amplifier via the first compensation capacitor, wherein a transfer function representation of the second closed-loop feedback network includes a fourth pole at an output of the first error amplifier and a fifth pole at a node between the first compensation capacitor and the drain terminal of the ninth transistor, wherein the fourth pole has a frequency that is lower than that of the fifth pole based on the active lag compensation, and wherein a transfer function representation of the voltage regulator includes a third pole at an output terminal of the voltage regulator having a frequency that is significantly higher than that of the fourth pole at the output of the first error amplifier.

13. The voltage regulator of claim 12, wherein the load tracking compensation circuit comprises:

a tenth transistor coupled to an output of the source follower and to the gate terminal of the pass device;

an eleventh transistor coupled to a drain terminal of the tenth transistor;

a twelfth transistor coupled to a gate terminal and a drain terminal of the eleventh transistor and configured to receive a same current conducting through the eleventh transistor;

a second error amplifier coupled to the gate terminal of the ninth transistor, wherein the twelfth transistor drives a drain voltage to a non-inverting input of the second error amplifier; and a second compensation capacitor coupled to the drain terminal of the twelfth transistor and to the amplifier, wherein the second compensation capacitor and the twelfth transistor generate a compensation zero to cancel the third pole at the output terminal of the voltage regulator at the given load current based on a gate voltage at a gate terminal of the twelfth transistor being proportional to a square root of the load current.

14. The voltage regulator of claim 2, wherein:

a small-signal closed loop transfer function of the first closed-loop feedback network is approximately equivalent to a wideband voltage buffer followed by a n-channel transistor, and the n-channel transistor has a first transconductance that is equivalent to a second transconductance of the pass device.

15. The voltage regulator of claim 2, wherein the load tracking compensation circuit comprises:

a thirteenth transistor coupled to an output of the source follower and to the gate terminal of the pass device;

a current mirror coupled to the thirteenth transistor and configured to receive a same current conducting through the thirteenth transistor; and a compensation capacitor coupled to the current mirror and to the amplifier.

16. The voltage regulator of claim 15, wherein the second closed-loop feedback network comprises:

an error amplifier coupled to an output terminal of the voltage regulator at a non-inverting input of the error amplifier and configured to drive the control voltage to the amplifier, wherein the compensation capacitor is coupled to an output of the error amplifier.

17. The voltage regulator of claim 2, wherein the load tracking compensation circuit comprises:

a fourteenth transistor coupled to an output of the source follower and to the gate terminal of the pass device;

a fifteenth transistor coupled to a drain terminal of the fourteenth transistor, wherein a gate terminal of the fifteenth transistor is tied to a drain terminal of the fifteenth transistor and to the drain terminal of the fourteenth transistor; and a sixteenth transistor coupled to a source terminal of the fifteenth transistor and to ground, wherein a gate terminal of the sixteenth transistor is tied to a drain terminal of the sixteenth transistor and to the source terminal of the fifteenth transistor.

18. The voltage regulator of claim 17, wherein the second closed-loop feedback network comprises:

a seventeenth transistor coupled to the power supply and configured to be biased by a first bias voltage produced at an output of the source follower;

an eighteenth transistor coupled to a drain terminal of the seventeenth transistor and to the amplifier;

an error amplifier coupled to an output terminal of the voltage regulator at a non-inverting input of the error amplifier and configured to drive an error voltage that biases a gate terminal of the eighteenth transistor;

a second pass device coupled to the drain terminal of the seventeenth transistor and to a drain terminal of the eighteenth transistor; and a compensation capacitor coupled to an output of the error amplifier and to a source terminal of the second pass device.

19. A device for voltage regulation, comprising:

means for receiving a supply voltage from a power supply in a first closed-loop feedback network;

means for detecting a load current with a load tracking compensation circuit;

means for adjusting a gain of a second closed-loop feedback network based on a dominant pole in the second closed-loop feedback network being a function of the load current;

means for regulating an output voltage that is smaller than the supply voltage between a first supply voltage rail and a second supply voltage rail for a given load current in the second closed-loop feedback network, wherein the second closed-loop feedback network produces a gain that is greater than that of the first closed-loop feedback network; and means for driving the output voltage to a load from the second closed-loop feedback network, wherein a transfer function representation of the first closed-loop feedback network includes a first pole and a second pole, wherein the first pole has a frequency that is higher than that of the second pole, wherein the second closed-loop feedback network produces a control voltage based on a reference voltage and the output, and wherein the first closed-loop feedback network is configured to detect a change in the control voltage.

* * * * *